US010710219B2

(12) United States Patent
Jiang

(10) Patent No.: US 10,710,219 B2
(45) Date of Patent: Jul. 14, 2020

(54) MECHANISM THAT IS NON-ENGAGING IN FORWARD DIRECTION AND PREVENTS DIRECTION CHANGE

(71) Applicant: Nantong Tianmao Machinery Manufacturing Co., Ltd., Nantong (CN)

(72) Inventor: Bubin Jiang, Nantong (CN)

(73) Assignee: Nantong Tianmao Machinery Manufacturing Co., Ltd., Nantong (CN)

( * ) Notice: Subject to any disclaimer, the term of this patent is extended or adjusted under 35 U.S.C. 154(b) by 304 days.

(21) Appl. No.: 15/992,192

(22) Filed: May 30, 2018

(65) Prior Publication Data

US 2018/0272506 A1 Sep. 27, 2018

Related U.S. Application Data

(63) Continuation of application No. PCT/CN2017/113568, filed on Nov. 29, 2017.

(30) Foreign Application Priority Data

Dec. 23, 2016 (CN) ..... 2016 1 1204474

(51) Int. Cl.
*B25B 13/46* (2006.01)
*B25B 13/06* (2006.01)
(Continued)

(52) U.S. Cl.
CPC ..... *B25B 13/465* (2013.01); *B25B 13/06* (2013.01); *B25B 23/0028* (2013.01); *B25B 13/005* (2013.01)

(58) Field of Classification Search
CPC ..... B25B 13/465; B25B 13/005; B25B 15/04; B25B 23/0028
See application file for complete search history.

(56) References Cited

U.S. PATENT DOCUMENTS

| | | | | |
|---|---|---|---|---|
| 8,931,374 | B2 * | 1/2015 | Chen | B25B 13/06 81/63.1 |
| 10,589,405 | B2 * | 3/2020 | Wang | B25B 17/00 |
| 2016/0167205 | A1 * | 6/2016 | Wang | B25B 15/04 81/58.3 |

* cited by examiner

*Primary Examiner* — David B. Thomas
(74) *Attorney, Agent, or Firm* — Hemisphere Law, PLLC; Zhigang Ma

(57) ABSTRACT

A mechanism that is non-engaging in the forward direction and prevents direction change, comprising a dual ratchet sleeve (1). The dual ratchet sleeve is provided in the axial direction a one-way forward ratchet ring gear and a one-way reverse ratchet ring gear; a pawl base (2), the pawl base being provided with a first pawl (21) and a second pawl (22) capable of moving in a direction perpendicular to the axis of the dual ratchet sleeve; an eccentric drive mechanism (3) for driving the first and second pawl to act, the axis of the eccentric wheel axle (32) of the eccentric drive mechanism being perpendicular to the axis of the dual ratchet sleeve; a tool handle (4) for driving the pawl base to rotate, the tool handle being connected to and fixed on the eccentric wheel (31) or the eccentric wheel axle (32) of the eccentric drive mechanism so as to enable the linkage of the tool handle and the eccentric wheel. The mechanism that is non-engaging in the forward direction and prevents direction change meets the working requirements under multiple states and directly enables torque transmission and state change by means of the handle.

7 Claims, 15 Drawing Sheets

(51) Int. Cl.
*B25B 23/00* (2006.01)
*B25B 13/00* (2006.01)

B-B

C-C

MECHANISM THAT IS NON-ENGAGING IN FORWARD DIRECTION AND PREVENTS DIRECTION CHANGE

TECHNICAL FIELD

The present disclosure relates to a ratchet mechanism, and more particularly to a steering mechanism with multiple states.

BACKGROUND

Ratchet wrenches often act as a fastening tool. When in use, a rotating component provided with ratchet on a circumferential side surface thereof, is connected to an end of a handle of the ratchet wrench, and one of the pair of locking claws/pawls guided in forward and reverse directions is selectively engaged with a ratchet wheel, to rotate the a fastening part in a forward direction or a reverse direction driven by the rotating component, directly or indirectly. And, a switching assembly connected to the locking claw performs the switching between the forward and reverse rotation directions (for example, as shown in Patent 1 and 2).

Patent 1: Patent Application Publication No. CN 102019595 A;

Patent 2: Patent Application Publication No. JP-A-2004-345011;

In the prior art, there are some defects as following:

(1) In the rotation of the handle to drive the rotating part, there are mainly two states: first, the handle rotates in the forward direction and the torque is transmitted to the rotating part; while in the reverse rotation, the rotating part slides relative to the handle; second, the handle rotates in the reverse direction and the torque is transmitted to the rotating part, while in the forward rotation, the rotating part slides relative to the handle, leading an idle state for the handle. However, in these states, the torque transmission between the handle and the rotating part in the forward and reverse directions cannot be cut at the same time. In some working conditions, a third state different from the first and second states is needed. Therefore, there are certain limitations when applying the traditional ratchet wrench in a variety of working conditions.

Of course, when the switching assembly controls the movement of the forward and reverse locking claws to a certain position, there may be cases where the forward and reverse locking claws disengage from the ratchet wheel at the same time, but this is not the original purpose of the switching operation, and that position is also unable to carry out accurate positioning and does not have normal working conditions;

(2) Each of the pair of locking claws needs to be controlled by one switching assembly to cooperate with the ratchet wheel to achieve the switching between the forward and reverse rotation directions, and it is inconvenience.

SUMMARY

The technical problem to be solved by the present disclosure is to provide a steering mechanism with multiple states, which is capable of realizing the requirements of various state working conditions, and is also capable of realizing torque transmission and state switching directly through a tool handle.

In order to solve the above technical problems, the technical solution of the present disclosure is to provide: a steering mechanism with multiple states, comprising:

a dual ratchet sleeve, provided in an axial direction a one-way forward ratchet ring gear and a one-way reverse ratchet ring gear;

a pawl base, the pawl base being provided with a upper portion and a lower portion disposed along the axial direction of the dual ratchet sleeve, the upper portion being received in and rotatable to the dual ratchet sleeve, thereby the pawl base is rotatable about the axis of the dual ratchet sleeve while being positionally restrained in the axial direction of the dual ratchet sleeve; the upper portion of the pawl base comprises a first pawl and a second pawl both being movable in a direction perpendicular to the axis of the dual ratchet sleeve, and the first pawl and second pawl being capable of moving into or disengaged from the one-way forward ratchet ring gear and the one-way reverse ratchet ring gear, respectively; the pawl base further comprises a drive lever guide hole through the upper portion and the lower portion, and an axis of the drive lever guide hole is parallel to the axis of the dual ratchet sleeve;

an eccentric drive mechanism, configured for driving the first and second pawl to act, comprising an eccentric wheel, an eccentric wheel axle, a pawl driving lever, and an elastic pressing part, the eccentric wheel being rotatably mounted to the lower portion of the pawl base through the eccentric wheel axle, an axis of the eccentric wheel axle being perpendicular to the axis of the dual ratchet sleeve; the pawl driving lever being restrained within the driving lever guide hole of the pawl base, and being movable in a direction parallel to the axis of the dual ratchet sleeve, the pawl driving lever being in contact with the first and second pawls in an area corresponding to upper portion of the pawl base, and the pawl driving lever is tightly attached to the surface of the eccentric wheel through the elastic pressing part at one end in the lower portion of the pawl base;

a tool handle for driving the pawl base to rotate, the tool handle being connected to and fixed on the eccentric wheel or the eccentric wheel axle so as to enable the linkage of the tool handle and the eccentric wheel;

wherein the tool handle drives the pawl driving lever to move in a direction parallel to the axis of the dual ratchet sleeve through the rotation movement of the eccentric wheel, and then the pawl driving lever drives the first pawl and the second pawl to move into or disengaged from the one-way forward ratchet ring gear and the one-way reverse ratchet ring gear, along direction perpendicular to the axis of the dual ratchet sleeve;

wherein, the tool handle is rotated to be positioned to a first position, a second position and a third position, and in the first position, the following conditions are occurred simultaneously:

(a) a longitudinal direction of the tool handle is perpendicular to the axial direction of the dual ratchet sleeve; and (b) the first pawl is engaged in the tooth slots of the one-way forward ratchet ring gear, and the second pawl is disengaged from the tooth slots of the one-way reverse ratchet ring gear;

in the second position, the following conditions are occurred simultaneously:

(c) the longitudinal direction of the tool handle is parallel to the axial direction of the dual ratchet sleeve; and (d) the first pawl and the second pawl respectively disengage from the tooth slots corresponding to the one-way forward ratchet ring gear and the one-way reverse ratchet ring gear;

in the third position, the following conditions are occurred simultaneously:

(e) the longitudinal direction of the tool handle is perpendicular to the axial direction of the dual ratchet sleeve; and (f) the second pawl is engaged in the tooth slots of the one-way reverse ratchet ring gear, and the first pawl is disengaged from the tooth slots of the one-way forward ratchet ring gear.

Furthermore, in the eccentric drive mechanism, the longitudinal direction of the pawl driving lever is defined to be parallel to the axis of the dual ratchet sleeve, and two side surfaces of the ratchet driving lever along the longitudinal direction is defined as a first side surface and a second side surface;

the pawl driving lever is set with a first pawl working section, a common working section and a second pawl working section in the longitudinal direction thereof;

the first pawl working section comprises on the first side surface a first inclined surface with an included angle with the longitudinal direction of the pawl driving lever;

the second pawl working section comprises a second inclined surface parallel to the first inclined surface on the second side surface, and the first inclined surface and the second inclined surface are oppositely arranged in the longitudinal direction of the pawl driving lever;

the common working section comprises a first parallel surface and a second parallel surface parallel to the longitudinal direction of the pawl driving lever on the first and second side surfaces, respectively, and the first parallel surface of the first side surface is adjacent to the first inclined surface to form a first a pawl drive surface, a second parallel surface of the second side is adjacent to the second inclined surface to form a second pawl drive surface;

the first pawl comprises a first guide portion that cooperates with the first pawl drive surface, and further comprises a first spring limit for position limitation, and a first return spring is disposed between the first spring limit and the pawl base;

the second pawl comprises a second guide portion that cooperates with the second pawl drive surface, and further comprises a second spring limit, a second return spring is disposed between the second spring limit and the pawl base.

Furthermore, the first pawl is engaged in the tooth slots of the one-way forward ratchet ring gear through the elastic deformation force of the first return spring, the second pawl is engaged in the tooth slots of the one-way reverse ratchet ring gear through the elastic deformation force of the second return spring; both of the first pawl and the second pawl are disengaged from the one-way forward ratchet ring gear and the one-way reverse ratchet ring gear by the pawl driving lever.

Furthermore, while the one-way forward ratchet ring gear is engaged with the first pawl, and the one-way reverse ratchet ring gear is engaged with the second pawl, the movement direction of the first and second pawls is 0 to 5 degrees with respect to the working surface of the tooth slots of the one-way forward ratchet ring gear and one-way reverse ratchet ring gear, and the movement direction of the first and second pawls is 50 to 60 degrees with respect to the non-working surface of the tooth slots of the one-way forward ratchet ring gear and one-way reverse ratchet ring gear.

Furthermore, the pawl base adopts a split type structure, and the upper portion of the pawl base comprises a fixed part base and a movable part, and the fixed part is integrated with the lower portion of the pawl base.

Furthermore, in the structure of the split-type pawl base, the working surfaces of the first pawl and the second pawl are located on the side of the movable part, and the non-working surfaces are located on the side of the fixed part.

Furthermore, the axis of the driving lever guide hole is located at the center of the pawl base and coincides with the axis of the dual ratchet sleeve.

The advantages of the present disclosure are:

(1) In the present disclosure, the first pawl and the second pawl are actuated by the action of the eccentric drive mechanism, so that one of the first and second pawls is engaged in the corresponding one-way forward ratchet ring gear or the one-way reverse ratchet ring gear, while the other is disengaged from the tooth slots of the corresponding one-way forward ratchet ring gear or the one-way reverse ratchet ring gear, or the first and second pawls simultaneously disengage from one-way forward ratchet ring gear or the one-way reverse ratchet ring gear. As such, the transmission direction of the torque between the dual ratchet sleeve and the pawl base is changed, and thus realizes three working states: forward rotation and reverse idling, reverse rotation and forward idling, forward idling and reverse idling.

(2) in the present disclosure, since the linkage between the tool handle and the eccentric wheel or the eccentric wheel axle of the eccentric drive mechanism is performed, the change of the torque transmission approach or direction between the dual ratchet sleeve and the pawl position can be realized by rotating the tool handle to drive the eccentric wheel rotates, and then the pawl driving lever is actuated in cooperation with the elastic pressing part, so that the first and second pawls are engaged or disengaged from the tooth slots of the one-way forward ratchet ring gear and the one-way reverse ratchet ring gears, respectively, thereby realizing the switching of working states, without Using extra switching assembly.

(3) In the present disclosure, the tool handle can be rotationally positioned in three positions, and in the first and third positions, one of the first and second pawls is engaged in the tooth slots of the corresponding one-way ratchet ring gear while the other is disengaged from the other corresponding one-way ratchet ring gear. In this state, the tool handle is required to drive the pawl base for torque transmission. In this position, the longitudinal direction of the tool handle is just perpendicular to the axis of the dual ratchet sleeve, making the tool handle in the most labor-saving position, further enhances the convenience.

(4) In the present disclosure, the dual ratchet sleeve adopts the one-way forward ratchet ring gear and the one-way reverse ratchet ring gear, so that the first and second pawls for controlling the rotation direction of the dual ratchet sleeve adopt a built-in installation approach. As such, the overall size of the steering mechanism of the present disclosure is effectively reduced, and the structure is more compact.

(5) In the present disclosure, the pawl driving lever of the eccentric drive mechanism adopts a segmented wedge-shaped structure, which cooperates with the guiding portion of the pawls, and combines the return springs to realize that the first and second pawls are moved perpendicular to the axis of the dual ratchet sleeve. In the three working conditions, the first and second pawl is in a front limit position or in a rear limit position, there is no intermediate position working state, therefore, the working position is clear and accurate.

As a preferred embodiment, by the elastic deformation force of the first and second return springs, the first and second pawls are engaged in the tooth slots of the one-way forward ratchet ring gear and the one-way reverse ratchet ring gear, and the pawl driving lever cooperates with the guiding portion of the first and second pawls to disengage the first and second pawls from the tooth slots of the one-way forward ratchet ring gear and the one-way reverse ratchet ring gears, preventing the dual ratchet sleeves from being tightly coupled with the first and second pawls in the mechanism to be unable to be separated, to ensure the reliability of the mechanism.

(6) In the present disclosure, regarding the selection of the angle between the moving direction of the first/second pawls and the tooth slots of the one-way ratchet ring gear, the angle range defined by the present disclosure makes the first and second pawls smoothly engaging or disengaging from the tooth slots of the one-way ratchet ring gear, and with less stuck situation.

(7) In the present disclosure, the pawl base adopts a combination of a fixed base and a movable base, which enables the first pawl, the second pawl, the first return spring and the second return spring to be easily mounted on the pawl base. At the same time, it also facilitates the manufacture of pawl bases.

(8) In the present disclosure, the drive lever guide hole for accommodating and guiding the pawl driving lever is provided at the center of the pawl base, which is easy to manufacture and have a good looking.

BRIEF DESCRIPTION OF THE DRAWINGS

The present disclosure will be further described in detail with reference to the accompanying drawings and specific embodiments.

DETAILED DESCRIPTION

The following examples may enable those skilled in the art to more fully understand the present disclosure, but do not limit the present disclosure to the scope of the described embodiments.

Example 1

FIGS. 1 to 8 show a structure of a steering mechanism with multiple states of this embodiment, which includes a dual ratchet sleeve 1, a pawl base 2, an eccentric drive mechanism 3, and a tool handle 4.

Figure 9:
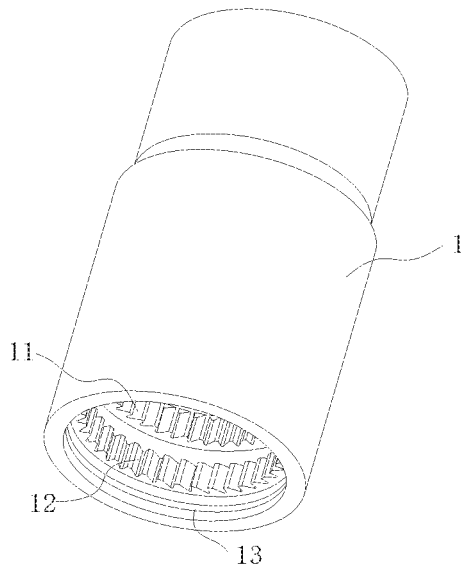
FIG. 9 is a schematic structural view of a dual ratchet sleeve of the steering mechanism according to the first embodiment of the present disclosure.

As shown in FIG. 9, the dual ratchet sleeves 1 includes a first one-way ratchet ring gear 11 and a second one-way one-way ratchet ring gear 12 distributed along its axial direction. One of the first and second one-way one-way ratchet ring gear 11 and 12 is a one-way forward ratchet ring gear while the other is a one-way reverse ratchet ring gear 12. In this embodiment, the first one-way ratchet ring gear 11 is one-way forward ratchet ring gear, and the second one-way ratchet ring gear 12 is one-way reverse ratchet ring gear.

In this embodiment, the one-way forward ratchet ring gear 11 and the one-way reverse ratchet ring gear 12 adopt a stepped structure, i.e., the one-way forward ratchet ring gear 11 and the one-way reverse ratchet ring gear 12 have different diameters, which is advantageous to directly integrate the one-way forward ratchet ring gear 11 and the one-way reverse ratchet ring gear 12 on the dual ratchet sleeve 1. At the same time, the integrally formed dual ratchet wheel sleeve minimizes the volume thereof, makes it easy to manufacture a compact steering mechanism with multiple states.

Figure 10:
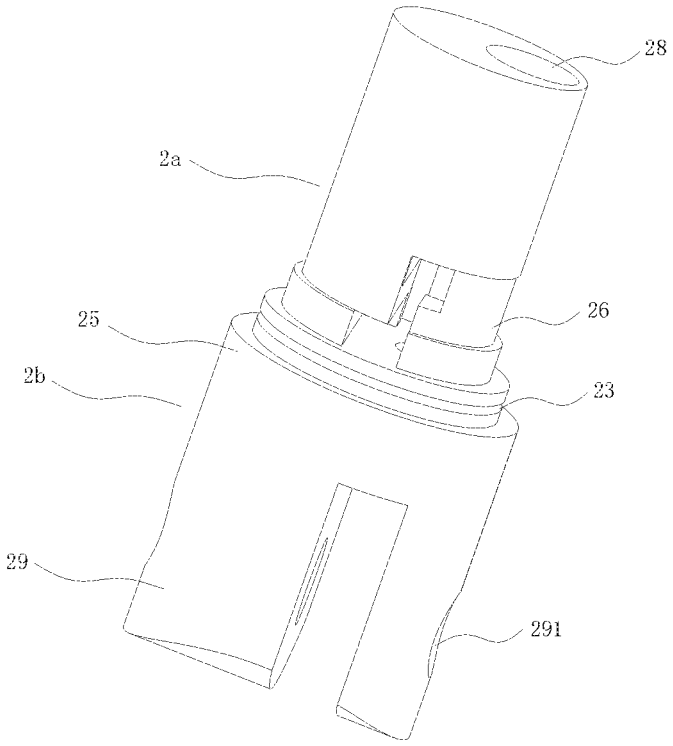
FIG. 10 is a schematic structural view of a pawl base structure of the steering mechanism according to the first embodiment of the present disclosure.

As shown in FIG. 10, the pawl base 2 is divided into an upper portion 2*a* and a lower portion 2*b* in the direction of the axis of the dual ratchet sleeve.

On an outer circumferential surface of the upper portion 2*a* of the pawl base, an outer annular circlip groove 23 is formed, and a corresponding inner annular circlip groove 13 is machined on the inner wall of the dual ratchet sleeve 1. The upper portion 2*a* of the pawl base is engaged in the dual ratchet sleeve 1. And, through a snap ring spring 5 mounted in the outer annular circlip groove 23 and the inner annular circlip groove 13, the upper portion 2*a* of the pawl base 2 is rotatably mounted in the dual ratchet sleeve 1, so that the pawl base 2 is rotatable about the axis of the dual ratchet sleeve 1, and is limited or positionally restrained in the direction of the axis of the dual ratchet sleeve 1.

The upper portion 2*a* of the pawl base 2 is provided with a first pawl 21 and a second pawl 22, and the first pawl 21 and the second pawl 22 are aligned to the one-way forward ratchet ring gear 11 and the one-way reverse ratchet ring gear 12, after the first pawl 21 and the second pawl 22 is mounted in the dual ratchet sleeve 1 on the upper portion 2*a* of the pawl base 2. Simultaneously, the first pawl 21 and the second pawl 22 are limited to be movable along a direction perpendicular to the axis of the dual ratchet sleeve 1 in the upper portion 2*a*. Further, when the first pawl 21 or the second pawl 22 is driven to move by an external force, an end portion of the first pawl 21 or the second pawl 22 is pushed into the corresponding one-way forward ratchet ring gear 11 or one-way reverse ratchet ring gear 12, to limit the relative rotation direction of the pawl base 2 and the dual ratchet sleeve 1.

In order to make the pawl and the ratchet wheel fit more smoothly and avoid jamming, when the one-way forward ratchet ring gear 11 is matched with the first pawl 21, and the one-way reverse ratchet ring gear 12 is matched with the second pawl, the movement direction of the first and second pawls is 0 to 5 degrees with respect to the working surface of the tooth slots of the one-way forward ratchet ring gear and one-way reverse ratchet ring gear, and the movement direction of the first and second pawls is 50 to 60 degrees with respect to the non-working surface of the tooth slots of the one-way forward ratchet ring gear and one-way reverse ratchet ring gear.

Herein, the working surface and the non-working surface specifically refer to: during the pawl (i.e., the first pawl or the second pawl) is in the process of engaging with the dual ratchet sleeve, and when the pawl drives the dual ratchet sleeve to rotate, the contact surface for the ratchet teeth of the pawl and the dual ratchet sleeve is the working surface; and when the pawl and the dual ratchet wheel sleeve slide relatively, the contact surface for the ratchet teeth of the pawl and the dual ratchet wheel sleeve is the non-working surface.

The lower portion 2*b* of the pawl base 2 is used to mount the main structure of a driving steering mechanism.

Regarding the driving steering mechanism, the present embodiment employs an eccentric drive mechanism 3, which includes an eccentric wheel 31, an eccentric wheel axle 32, a pawl driving lever 33, and an elastic pressing part 34. The eccentric wheel 31 is rotatably mounted to the lower portion of the pawl base 2 through the eccentric wheel axle 32. The axis of the eccentric wheel axle 32 is perpendicular to the axis of the dual ratchet sleeve 1. The pawl driving lever 33 is constrained inside the pawl base 2. The pawl base 2 includes a drive lever guide hole 27 parallel to the axis of the dual ratchet sleeve 1, and the pawl driving lever 33 is disposed in the drive lever guide hole 27, so that the pawl driving lever 33 is movable in a direction parallel to the axis of the dual ratchet sleeve 1. The pawl driving lever 33 is partly in contact with the first and second pawls in the upper portion 2*a* of the pawl base, and the pawl driving lever 33 is pressed against or tightly attached to the surface of the eccentric wheel 31 through the elastic pressing part 34 at one end in the lower portion of the pawl base.

When the elastic pressing part 34 presses the pawl driving lever 33 against the surface of the eccentric wheel 31, the elastic pressing part 34 is selectively disposed at an end of the ratchet driving lever 33 away from the eccentric wheel 31 in the direction of a length axis of the pawl driving lever 33. The elastic pressing part 34 is received in a mounting hole 28 at the top of the pawl base 2 and is fixed by a sealing head.

This method mentioned above is selected to facilitate the replacement and maintenance of the elastic pressing part 34 on one hand, and on the other hand, when the pawl holder 2 is machined, the cavity for accommodating the pawl driving lever and the mounting hole 28 for placing the elastic pressing part 34 is used as a common hole for easy processing.

As a more specific embodiment of this embodiment, for the eccentric drive mechanism 3, the operation of the first pawl 21 and the second pawl 22 is realized by the combination of the pawl driving lever 33 and the elastic return part. That is, the pawl driving lever 33 drives the first pawl 21 and the second pawl 22 to move in a one-way direction perpendicular to the axial direction of the dual ratchet sleeve 1, and the elastic return part drives the first pawl 21 and the second pawl 22 to move in the other one-way direction perpendicular to the axial direction of the dual ratchet sleeve 1.

Figure 11:
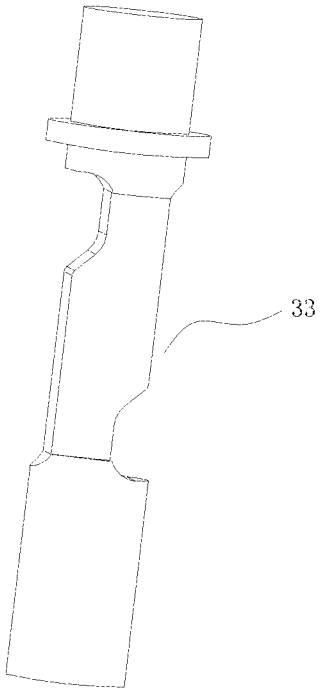
FIG. 11 is a schematic structural view of a pawl driving lever of the steering mechanism according to the first embodiment of the present disclosure.
Figure 12:
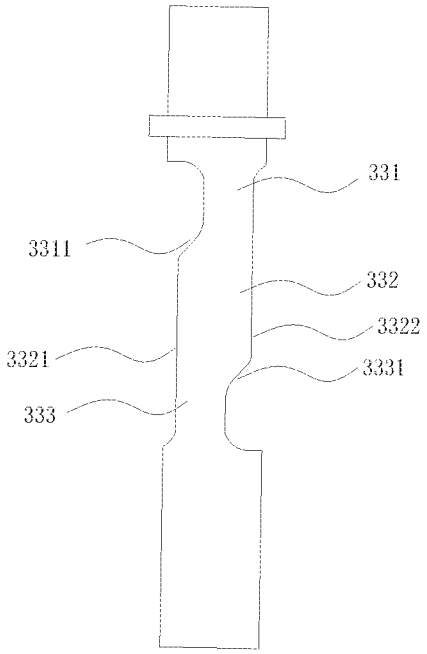
FIG. 12 is a front view of the pawl driving lever of the steering mechanism according to the first embodiment of the present disclosure.

The specific plan is as follows:

Defining the longitudinal direction of the pawl driving lever 33 is parallel to the axis of the dual ratchet sleeve 1, and defining two side surfaces of the ratchet driving lever along the longitudinal direction is defined as a first side surface and a second side surface;

As shown in FIGS. 11 and 12, the pawl driving lever 33 is configured in a segmented wedge-shaped configuration. The pawl driving lever is provided with a first pawl working section 331, a common working section 332, and a second pawl working section 333 in the longitudinal direction thereof.

The first pawl working section 331 comprises on the first side surface a first inclined surface 3311 with an included angle with the longitudinal direction of the pawl driving lever 33.

The second pawl working section 333 comprises a second inclined surface 3331 parallel to the first inclined surface 3311 on the second side surface, and the first inclined surface 3311 and the second inclined surface 3331 are oppositely arranged in the longitudinal direction of the pawl driving lever 33.

The common working section 332 includes a first parallel surface 3312 and a second parallel surface 3332 parallel to the longitudinal direction of the pawl driving lever 33 on the first and second side surfaces respectively, and the first parallel surface 3312 of the first side surface is adjacent to the first inclined surface 3311 to form a first pawl drive surface, and the second parallel surface 3332 of the second side surface and the second inclined surface 3331 are disposed adjacent to each other to form a second pawl drive surface.

Figure 13:
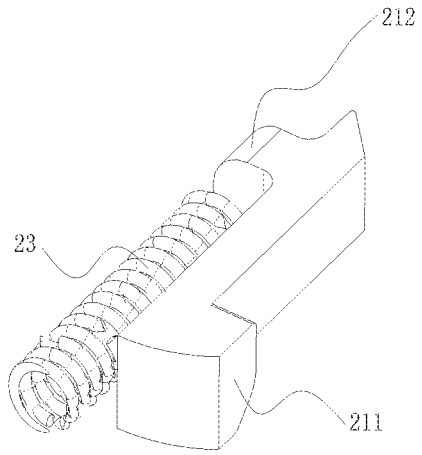
FIG. 13 is a schematic structural view of a first pawl and a first return spring of the steering mechanism according to the first embodiment of the present disclosure.

As shown in FIG. 13, the first pawl 21 includes a first guide portion 211 cooperating with the first pawl drive surface, and further includes a first spring limit 212. A first return spring 23 is disposed between the first spring limit 212 and the pawl base 2.

Figure 14:
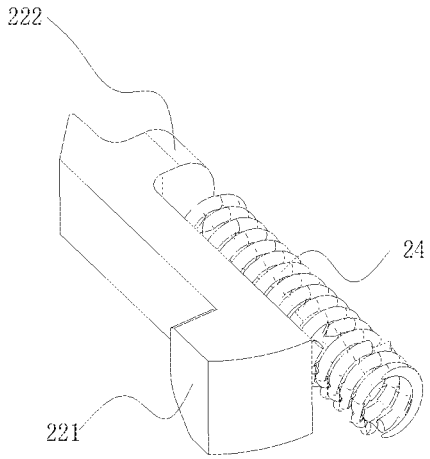
FIG. 14 is a schematic structural view of a second pawl and a second return spring of the steering mechanism according to the first embodiment of the present disclosure.

As shown in FIG. 14, the second pawl. 22 includes a second guide portion 221 that cooperates with the second pawl drive surface, and further includes a second spring limit 222. A second return spring 24 is disposed between the second spring limit 222 and the pawl base 2.

When the pawl driving lever 33 and the elastic return part are respectively adopted as the driving force for driving the first pawl 21 and the second pawl 22 to engage or disengage from the one-way forward ratchet ring gear 11 and the one-way reverse ratchet ring gear 12, it is preferable to use the elastic deformation force of the elastic return part to push the first pawl 21 and the second pawl 22 into the one-way forward ratchet ring gear 11 and the one-way reverse ratchet ring gear 12, while use the pawl driving lever to reversely disengage the first pawl 21 and the second pawl 22 from the one-way forward ratchet ring gear 11 and the one-way reverse ratchet ring gear 12.

The target for the above approach is: to avoid the situation that the dual ratchet sleeve engages with the first and second pawls too fasten to be separated from each other in the mechanism, and ensure the reliability of the mechanism.

Figure 7:
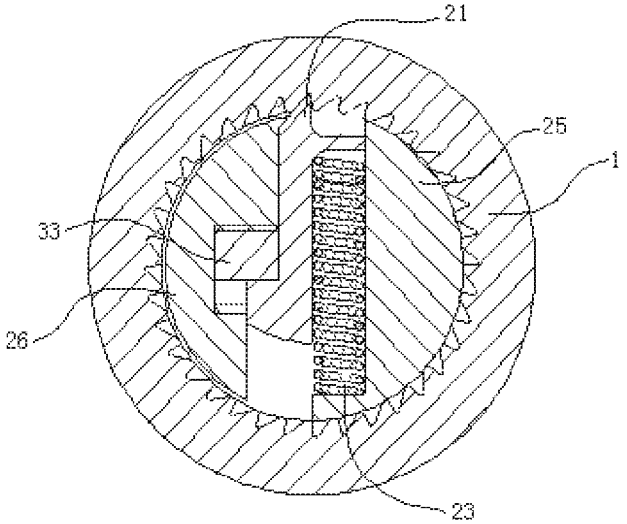
FIG. 7 is a sectional view taken along line B-B in FIG. 6.
Figure 8:
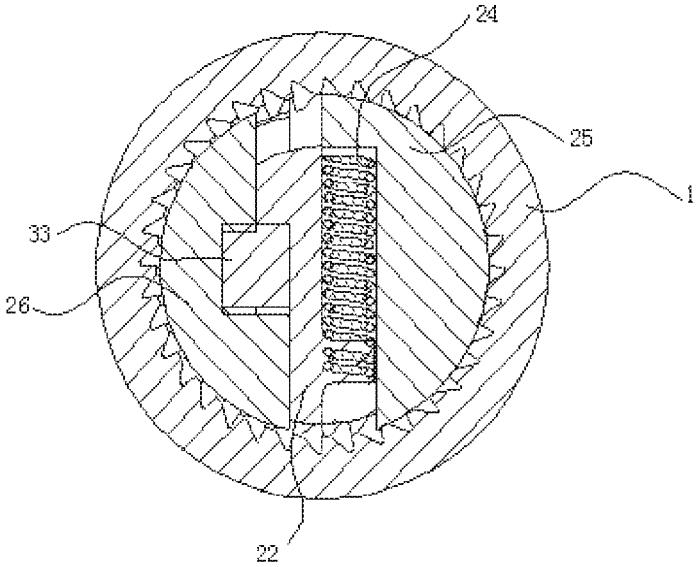
FIG. 8 is a sectional view taken along line C-C in FIG. 6.

In order to allow the first pawl 21, the second pawl 21 the first return spring 23, and the second return spring 24 to be easily mounted on the pawl base 2, and further for the pawl base 2 being facilitated to be manufactured, the pawl base 2 is structured in the form of a combination of a fixed base 25 and a movable base 26 (see FIG. 10 and FIG. 7). The upper portion 2*a* of the pawl base 2 adopts a fixed part and a movable part. The fixed part is formed as a whole with the lower portion 2*b* of the pawl base 2, and the movable part directly positioned through an inner ring of the dual ratchet sleeve and is tightly contacted to one side surface of the fixed part.

In a structure using a split pawl base, as shown in FIG. 7, the working surfaces of the first pawl 21 and the second pawl 22 in this figure are disposed on the side of the fixed part, and the non-working surface is disposed on the side of the movable part. When the pawl rotates the dual ratchet sleeve, the reaction force of the pawl is supported by the movable part.

When the steering mechanism of this embodiment is working, the pawl base 2 needs to be rotated by the tool handle 4, and at the same time, the tool handle 4 is required to change the way or direction of torque transmission between the dual ratchet sleeve 1 and the pawl base 2 through the eccentric drive mechanism 3.

In this embodiment, the tool handle 4 is arranged to be fixedly connected with the eccentric wheel 31 or the eccentric wheel axle 32, to realize the linkage between the tool handle 4 and the eccentric drive mechanism 3; so that the tool handle 4 is moved in a direction parallel to the axis of the dual ratchet sleeve 1, driven by the rotation of the eccentric wheel 31 to drive the pawl driving lever 33 to further drive the first pawl 21 and the second pawl 22 to move in or disengaged from the one-way forward ratchet ring gear and the one-way reverse ratchet ring gear along the direction perpendicular to the axis of the dual ratchet sleeve 1.

Wherein, the tool handle 4 is easily positioned to a first position, a second position and a third position when it is rotated.

Specifically, in the first position, the following conditions are occurred simultaneously:

(a) a longitudinal direction of the tool handle 4 is perpendicular to the axial direction of the dual ratchet sleeve 1; and (b) the first pawl 21 is engaged in the tooth slots of the one-way forward ratchet ring gear 11, and the second pawl 22 is disengaged from the tooth slots of the one-way reverse ratchet ring gear 12.

In the second position, the following conditions are occurred simultaneously:

(c) the longitudinal direction of the tool handle 4 is parallel to the axial direction of the dual ratchet sleeve 1; and (d) the first pawl 21 and the second pawl 22 respectively disengage from the tooth slots corresponding to the one-way forward ratchet ring gear 11 and the one-way reverse ratchet ring gear 12.

In the third position, the following conditions are occurred simultaneously:

(e) the longitudinal direction of the tool handle 4 is perpendicular to the axial direction of the dual ratchet sleeve 1; and (f) the second pawl 22 is engaged in the tooth slots of the one-way reverse ratchet ring gear 12, and the first pawl 21 is disengaged from the tooth slots of the one-way forward ratchet ring gear 11.

Wherein, when the tool handle 4 is rotated and positioned to the first position and the third position, the longitudinal direction of the tool handle 4 is just perpendicular to the axis direction of the dual ratchet sleeve 1, so that the tool handle 4 is in the most labor saving position, further improving the convenience.

Figure 1:
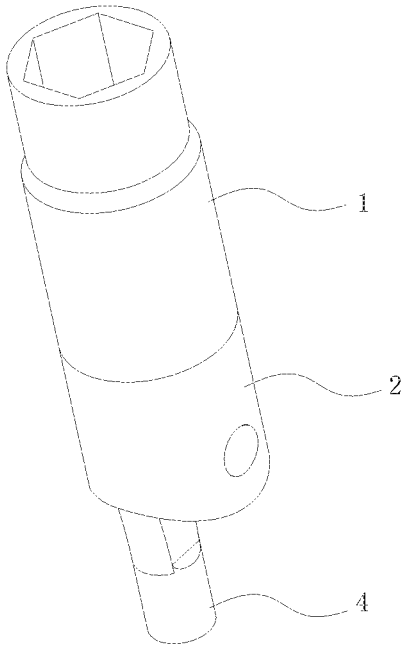
FIG. 1 is a schematic view of a steering mechanism with multiple states, according to a first embodiment of the present disclosure.
Figure 2:
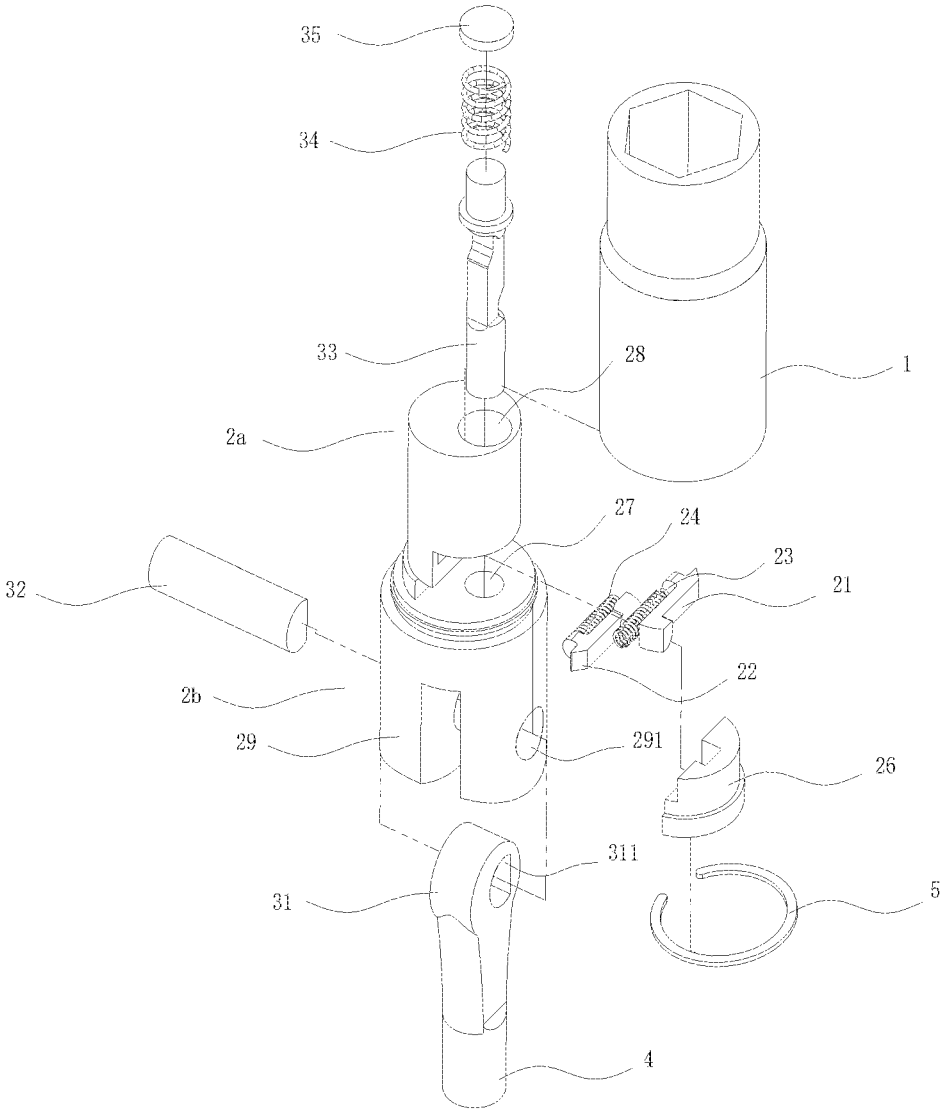
FIG. 2 is a schematic exploded view of the steering mechanism with multiple states, according to the first embodiment of the present disclosure.
Figure 3:
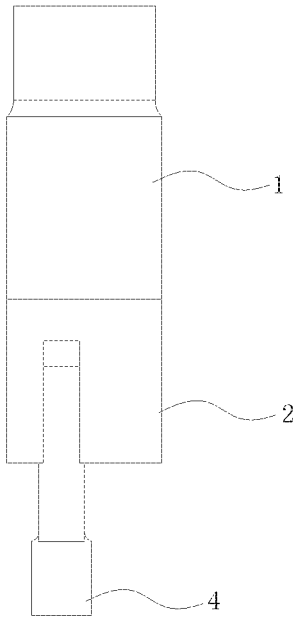
FIG. 3 is a front view of the steering mechanism with multiple states, according to the first embodiment of the present disclosure.
Figure 4:
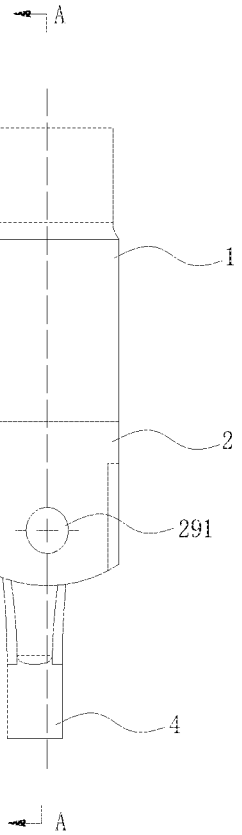
FIG. 4 is a side view of the steering mechanism with multiple states, according to the first embodiment of the present disclosure.
Figure 5:
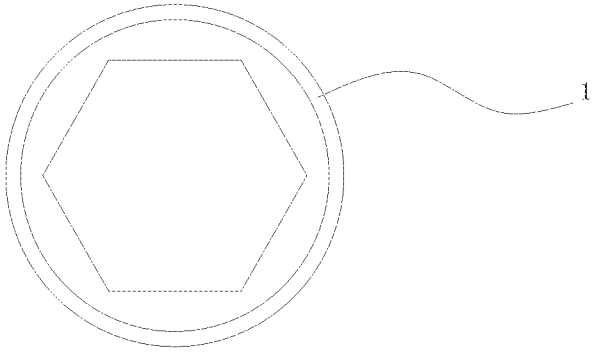
FIG. 5 is a top view of the steering mechanism with multiple states, according to the first embodiment of the present disclosure.
Figure 6:
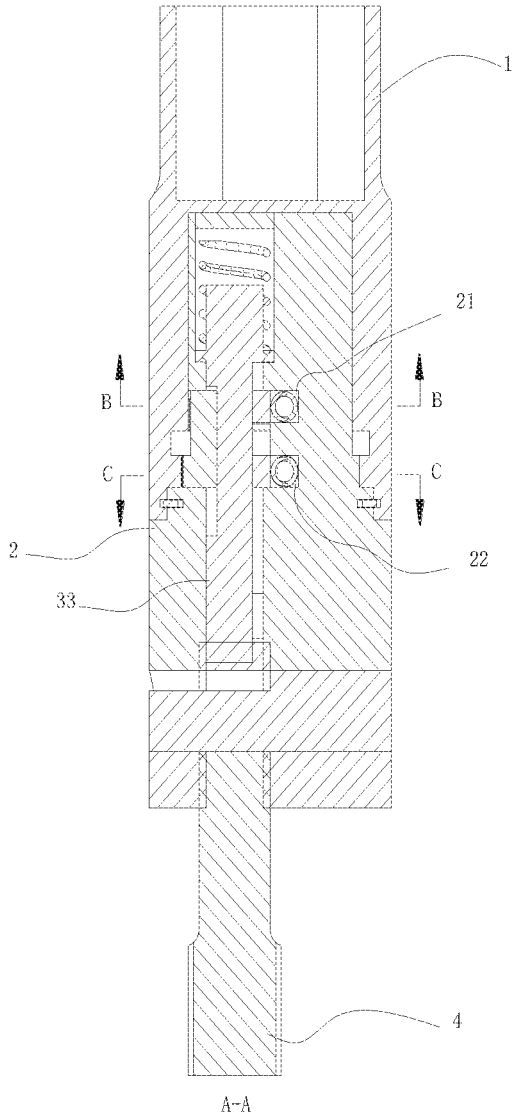
FIG. 6 is a sectional view taken along line A-A in FIG. 4.

In this embodiment, the connection between the pawl base 2, the eccentric drive mechanism 3 and the tool handle 4 is:

In the first approach shown in FIG. 2, the eccentric wheel 31 is integrated with the tool handle 4, and the lower portion 2*b* of the pawl base 2 employs a dual connecting plate structure with two connecting plates 29 for supporting the shaft. The connecting plate 29 includes a shaft hole 291. The eccentric wheel 31 is rotatably mounted in a gap formed between the two connecting plates 29 via the eccentric wheel axle 32 and corresponds to the pawl driving lever 33.

Figure 15:
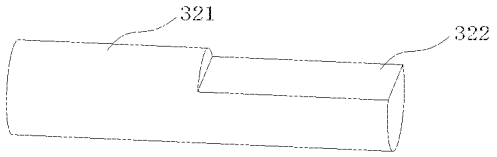
FIG. 15 is a schematic view of an eccentric wheel axle of the steering mechanism according to the first embodiment of the present disclosure.

In this approach, as shown in FIG. 15, the eccentric wheel axle 32 adopts a stepped structure, which is formed by cutting part of a cylindrical shaft body along its own axis, so that the eccentric wheel axle 32 includes a cylindrical section 321 and a non-cylindrical section 322 in the longitudinal direction. A cross section of the non-cylindrical section 322 is a plane pattern consisting of an arc and a chord.

The eccentric wheel 31 is directly formed into a one-piece structure with the tool handle 4, and the eccentric wheel 31 is centered with an eccentric axle connecting hole 311 that just accommodates the non-cylindrical section, so that the torque between the eccentric wheel 31 and the eccentric axle 32 is transmitted pass through the non-cylindrical section 322. The part of the eccentric wheel axle 32 that is engaged in one of the connecting plates is the cylindrical section 321, and the part that is engaged in the other connecting plate is a non-cylindrical section 322, Because the non-cylindrical section 322 is formed by cutting part of the cylindrical shaft section, the eccentric wheel axle 32 is capable of being supported in the dual connecting plate structure of the pawl base 2 and rotates. Therefore, the eccentric wheel 31 can rotate about the axis of the eccentric wheel axle 32 by rotating the tool handle 4.

Figure 16:
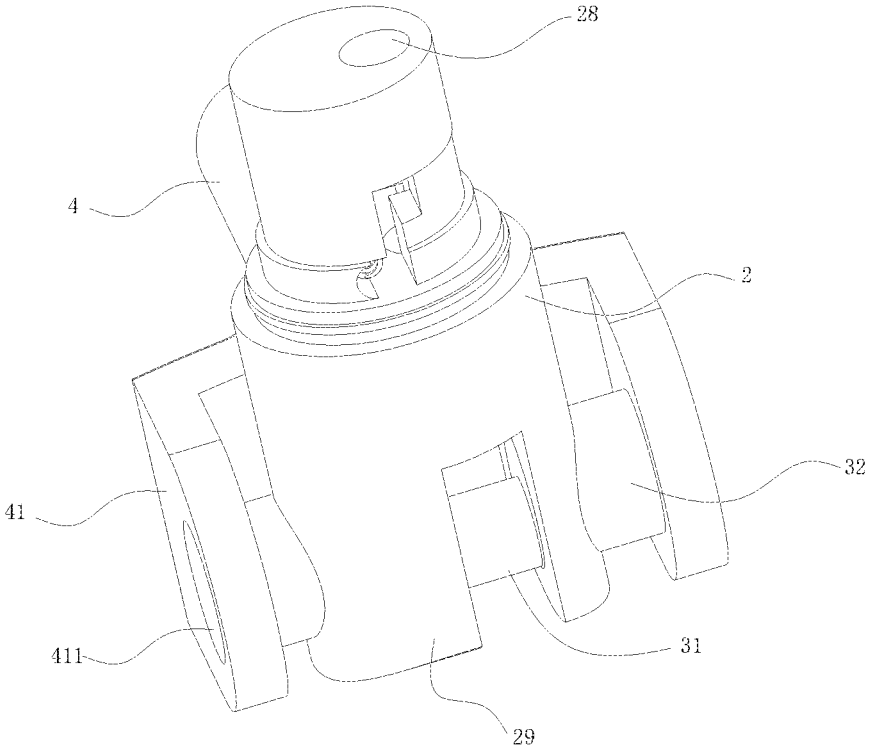
FIG. 16 is a structural diagram of a second connection between the pawl base, an eccentric drive mechanism, and the tool handle of the steering mechanism according to the first embodiment of the present disclosure.

In the second approach shown in FIG. 16, an eccentric profile is machined in the center of the eccentric wheel axle 32, such that the eccentric wheel 31 and the eccentric wheel axle 32 are integrally formed.

The lower portion 2*b* of the pawl base 2 adopts a dual connecting plate structure, which includes two connecting plates 29 disposed on an inner portion of the axle, each connecting plate includes a shaft hole 291. The tool handle 4 adopts a Y-shaped structure with two connecting plates 41 disposed on an outer portion of the axle. The connecting plate 41 also has a shaft hole 411.

The eccentric wheel axle 32 is rotatably disposed on the lower portion 2*b* of the pawl base 2 through the two inner connecting plates 29, and the eccentric wheel 31 is disposed in the gap between the two inner connecting plates 29 and corresponds to the pawl driving lever 33. Both ends of the eccentric wheel axle 32 are inserted into the shaft holes 411 of the outer connecting plate 41, respectively, and are connected and fixed with the outer connecting plate 41. Then, the eccentric wheel axle 32 and the eccentric wheel 31 are rotated around the axis of the eccentric wheel axle 32 by the tool handle 4.

Figure 17:
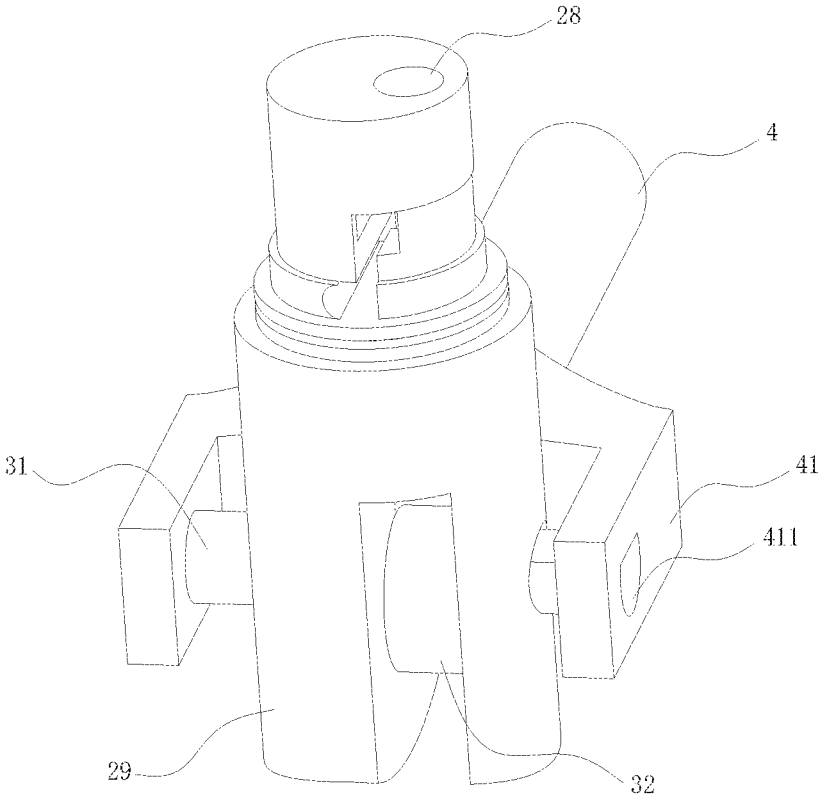
FIG. 17 is a structural diagram of a third connection between the pawl base, the eccentric drive mechanism, and the tool handle of the steeling mechanism according to the first embodiment of the present disclosure.

A third approach shown in FIG. 17 is basically the same as the first approach, except that the eccentric wheel 31 and the tool handle 4 adopt a split type structure. The tool handle 4 also adopts a Y-shaped structure with two connecting plates 41 disposed on the outer portion of the axle. Two ends of the eccentric wheel axle 32 extend axially beyond the connecting plate 19 of the pawl base 2 and are connected to the tool handle 4. The eccentric wheel 31 is driven in rotation by the eccentric wheel axle 32 fixedly connected to the tool handle 4.

Figure 18:
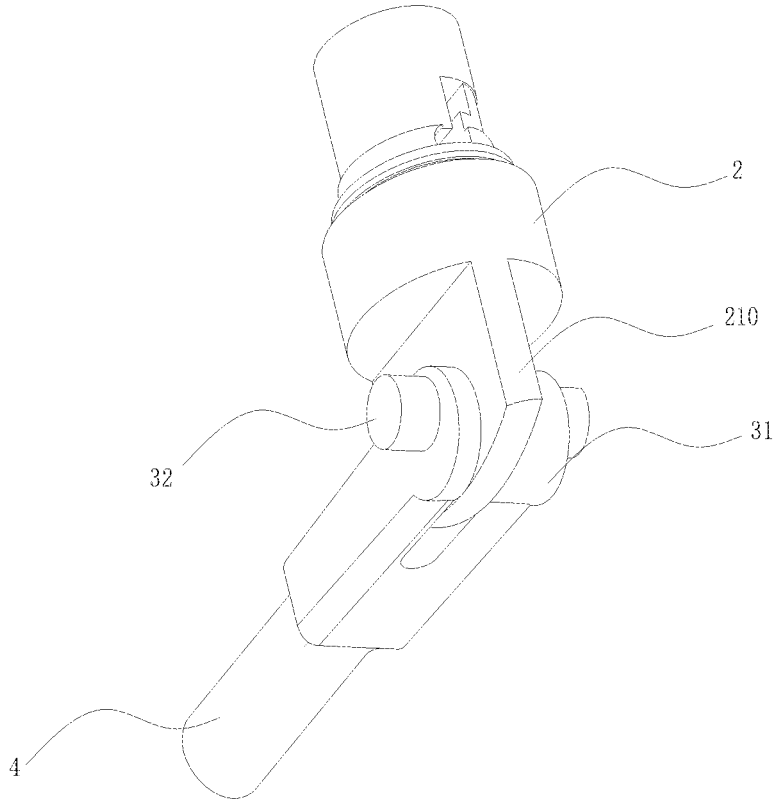
FIG. 18 is a structural diagram of a fourth connection between the pawl base, the eccentric drive mechanism, and the tool handle of the steering mechanism according to the first embodiment of the present disclosure.

In the fourth approach shown in FIG. 18, the tool handle 4 is a Y-shaped structure, and two ends thereof are configured to comprise a structure similar to the outer contour structure of the eccentric wheel. That is, the tool handle 4 is formed integrally with the eccentric wheel 31. A mounting hole 312 for mounting the eccentric wheel axle 32 is opened on the eccentric wheel 31. The lower portion 2*b* of the pawl base 2 adopts a single connecting plate 210 structure, the single connecting plate 210 has a shaft hole through which the eccentric wheel axle 32 passes. And two eccentrics wheels 31 disposed at the top of the tool handle 4 is disposed on both sides of the single connecting plate 210, and the tool handle 4 is rotatably mounted on the pawl base 2 through the eccentric wheel axle 32. In addition, one of the two eccentric wheels 31 at the top end of the tool handle 4 is corresponding to the pawl driving lever 33, the rotation of the tool handle 4 around the eccentric wheel axle 32 directly drives the eccentric wheel 31 to rotate.

Example 2

Figure 19:
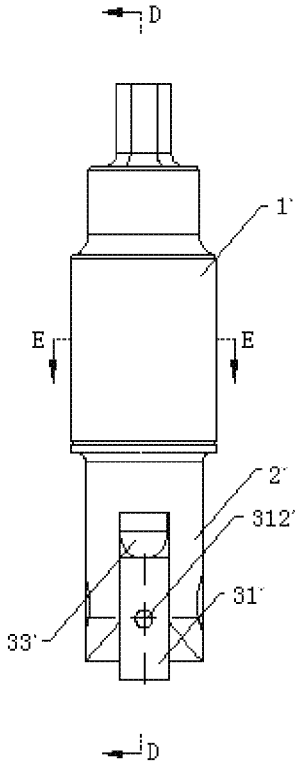
FIG. 19 is a front view of the steering mechanism according to a second embodiment of the present disclosure.
Figure 20:
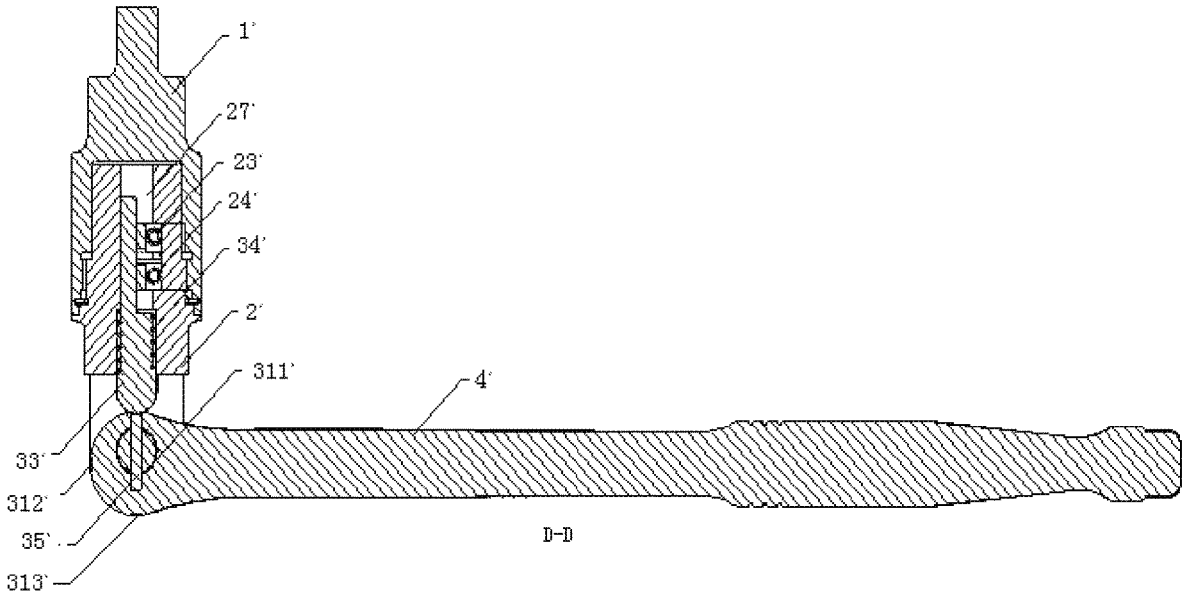
FIG. 20 is a sectional view taken along line D-D in FIG. 19.
Figure 21:
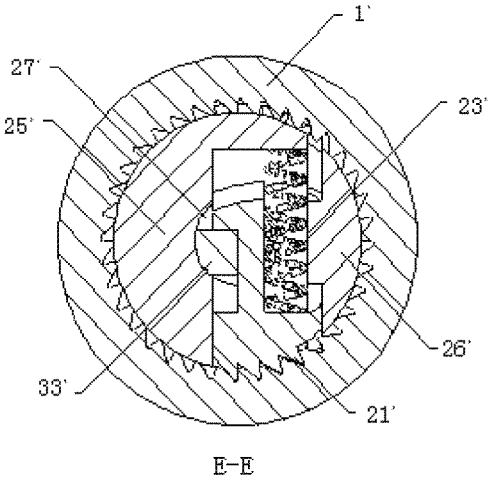
FIG. 21 is a sectional view taken along line E-E in FIG. 19.

FIGS. 19 to 21 show the structure of the steering mechanism of this embodiment. The structure includes the dual ratchet sleeve 1, the pawl base 2, the eccentric drive mechanism 3, and the tool handle 4. As compared with the embodiment 1, the position of the drive lever guide hole 27 which is extending from the upper portion to the lower portion in the pawl base 2, the structure of the center eccentric wheel 31, the eccentric wheel axle 32, and the pawl driving lever 33 of the eccentric drive mechanism 3, are changed.

As shown in FIG. 20, the axis of the drive lever guide hole 27 of this embodiment is located at the center of the pawl base, and coincides with the axis of the dual ratchet sleeve 1, this design is convenient for manufacture and artistic.

In this embodiment, the structure uses the split type pawl base. As shown in FIG. 21, the working surfaces of the first pawl 21 and the second pawl 22 are located on the side of the movable part, and the non-working surfaces are located on the side of the fixed part. When the pawl rotates the dual ratchet sleeve, the reaction force of the pawl is supported by the fixed part. Therefore, with the structure shown in FIG. 21, the supporting structure of the pawl is more stable and reliable. In addition, in order that the pawl and the dual ratchet sleeve can be engaged more stably, the ratchet teeth of the pawl can be set to plural.

Figure 22:
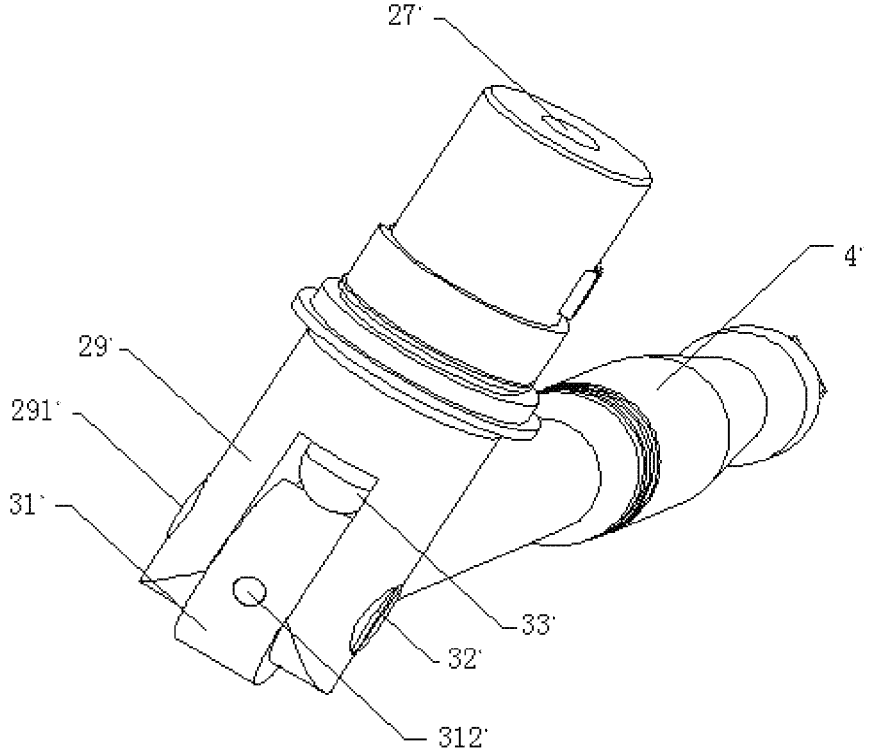
FIG. 22 is a structural diagram of a connection between the pawl base, the eccentric drive mechanism and the tool handle of the steering mechanism according to the second embodiment of the present disclosure.

In addition, in the present embodiment, the connection way between the pawl base 2, the eccentric drive mechanism 3, and the tool handle 4 may be: as shown in FIG. 22, the eccentric wheel 311 is integrally formed with the tool handle 4. The lower portion of the pawl base 2 employs a dual connecting plate structure with two connecting plates 29 for supporting the shaft or axal. The connecting plate 29 includes a shaft hole 291. The eccentric wheel 31 is rotatable mounted in a gap formed between the two connecting plates 29 via the eccentric wheel axle 32 and corresponds to the pawl driving lever 33.

Figure 23:
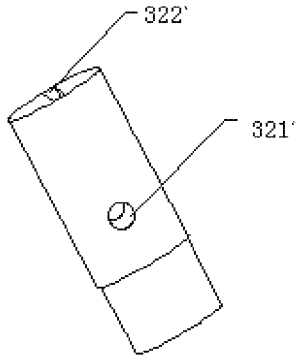
FIG. 23 is a schematic structural view of an eccentric wheel axle of the steering mechanism according to the second embodiment of the present disclosure.
Figure 24:
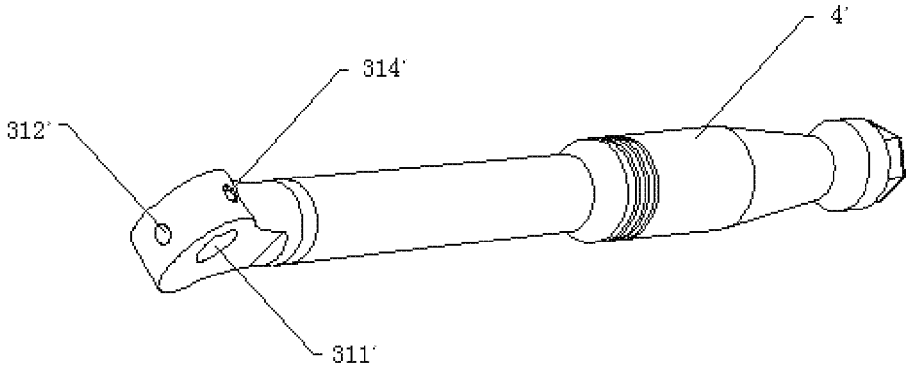
FIG. 24 is a schematic structural view of an eccentric wheel and a tool handle of the steering mechanism according to the second embodiment of the present disclosure.

As shown in FIG. 23, in this embodiment, the eccentric wheel axle 32 adopts a stepped structure, which includes two cylinder sections with different diameters and connected with each other. A first cylinder section thereof has a receiving hole 321 extended from top to bottom in a radial direction. The receiving hole 321 is capable of receiving a connecting shaft 35. A groove 322 is defined at a center of an outer end surface of the first cylinder section. As shown in FIG. 24, the eccentric wheel 31 and the tool handle 4 are in an integral structure. The eccentric wheel 31 is provided with a connecting hole 311 at the center which can just fit the cylindrical eccentric wheel axle. The eccentric wheel 31 includes a first positioning hole 312, a second positioning hole 313, and a positioning hole 314 are distributed at equal intervals in the circumferential direction. The first positioning hole 312 is disposed on an extension line of the axis of the tool handle 4. The central axis of the second positioning hole 313 and the positioning hole 314 are respectively perpendicular to that of the first positioning hole 312. The second positioning hole 313 and positioning hole 314 are located on the extension line of the axis of the pawl driving lever 33. An inner cavity of the eccentric wheel 31 formed between the second positioning hole 313 and the positioning hole 314 is provided with an accommodating chamber for accommodating the connecting shaft 35. The connecting shaft 35 and the positioning hole 314 cooperate to form a third positioning hole. With such connection, further strengthen the connection between the eccentric wheel 31 and the eccentric wheel axle 32, thus the rotation of the tool handle 4 can directly drive the eccentric wheel 31 to rotate about the axis of the eccentric wheel axle 32.

Figure 25:
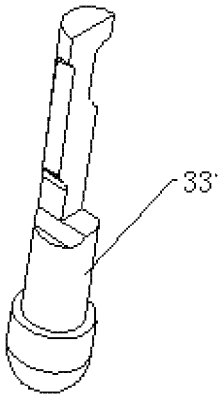
FIG. 25 is a schematic structural view of a pawl driving lever of the steering mechanism according to the second embodiment of the present disclosure.

In order to cooperate with the eccentric wheel 31, the pawl drive lever 33 is limited in the drive lever guide hole 27 of the pawl base 2, As shown in FIG. 25, a lower end of the pawl drive lever 33 is machined with a protruding ball structure, making the pawl driving lever 33 to match with the first positioning hole 312 of the eccentric wheel 31 better. At the same time, in the present embodiment, when the driving lever 33 is pressed against the surface of the eccentric wheel 31 by the elastic pressing part 34, the elastic pressing part 34 is selectively disposed at one end of the pawl driving lever 33 near the eccentric wheel 31 in the direction of the length axis.

Application Example

Figure 26:
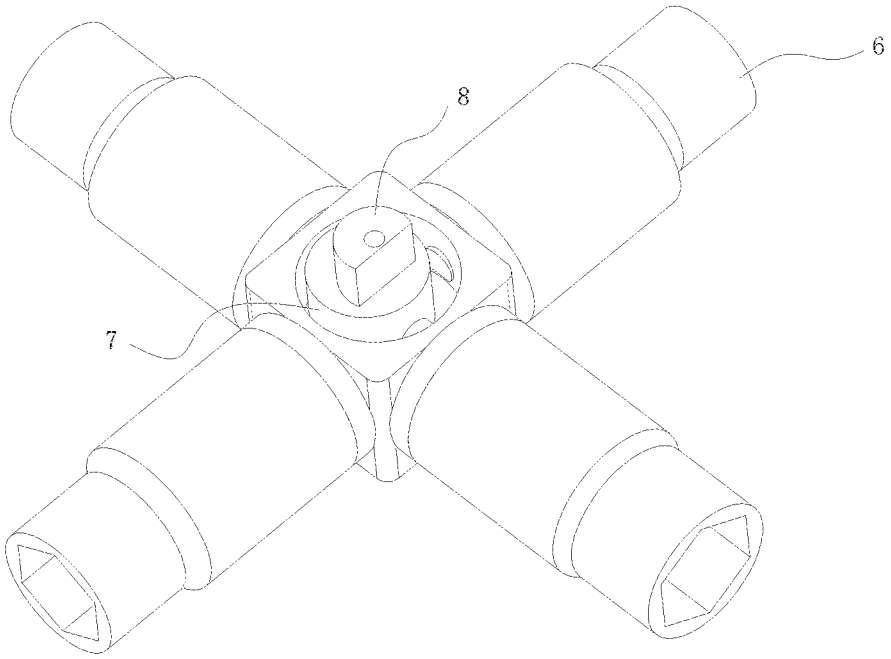
FIG. 26 is a schematic structural view of a socket wrench for car maintenance using steering mechanism according to the first embodiment of the present disclosure.

FIG. 26 shows a socket wrench for automotive maintenance using the steering mechanism of embodiment 1, including four cross-shaped steering mechanisms 6 that share an eccentric wheel 7 and a tool handle 8 connected to the eccentric wheel 7. The dual ratchet sleeve in the steering mechanism 6 have sleeves with different specifications or have quick connection structures for assembling different sleeves in different sizes or specifications.

The basic principle and main features of the present disclosure and the advantages of the present disclosure have been shown and described above. It should be understood by those skilled in the art that the present disclosure is not limited by the foregoing embodiments. The foregoing embodiments and descriptions describe the principle of the present disclosure, and the present disclosure also has other embodiments without departing from the spirit and scope of the present disclosure. Various changes and modifications are within the scope of the claimed disclosure. The scope of the disclosure is defined by the appended claims and their equivalents.

What is claimed is:

1. A steering mechanism with multiple states, comprising:

a dual ratchet sleeve, provided in an axial direction a one-way forward ratchet ring gear and a one-way reverse ratchet ring gear;

a pawl base, the pawl base being provided with a upper portion and a lower portion disposed along the axial direction of the dual ratchet sleeve, the upper portion being received in and rotatable to the dual ratchet sleeve, thereby the pawl base is rotatable about the axis of the dual ratchet sleeve while being positionally restrained in the axial direction of the dual ratchet sleeve; the upper portion of the pawl base comprises a first pawl and a second pawl both being movable in a direction perpendicular to the axis of the dual ratchet sleeve, and the first pawl and second pawl being capable of moving into or disengaged from the one-way forward ratchet ring gear and the one-way reverse ratchet ring gear, respectively; the pawl base further comprises a drive lever guide hole through the upper portion and the lower portion, and an axis of the drive lever guide hole is parallel to the axis of the dual ratchet sleeve;

an eccentric drive mechanism, configured for driving the first and second pawl to act, comprising an eccentric wheel, an eccentric wheel axle, a pawl driving lever, and an elastic pressing part, the eccentric wheel being rotatably mounted to the lower portion of the pawl base through the eccentric wheel axle, an axis of the eccentric wheel axle being perpendicular to the axis of the dual ratchet sleeve; the pawl driving lever being restrained within the driving lever guide hole of the pawl base, and being movable in a direction parallel to the axis of the dual ratchet sleeve, the pawl driving lever being in contact with the first and second pawls in an area corresponding to upper portion of the pawl base, and the pawl driving lever is tightly attached to the surface of the eccentric wheel through the elastic pressing part at one end in the lower portion of the pawl base;

a tool handle for driving the pawl base to rotate, the tool handle being connected to and fixed on the eccentric wheel or the eccentric wheel axle so as to enable the linkage of the tool handle and the eccentric wheel;

wherein the tool handle drives the pawl driving lever to move in a direction parallel to the axis of the dual ratchet sleeve through the rotation movement of the eccentric wheel, and then the pawl driving lever drives the first pawl and the second pawl to move into or disengaged from the one-way forward ratchet ring gear and the one-way reverse ratchet ring gear, along direction perpendicular to the axis of the dual ratchet sleeve;

wherein, the tool handle is rotated to be positioned to a first position, a second position and a third position, and in the first position, the following conditions are occurred simultaneously:

(a) a longitudinal direction of the tool handle is perpendicular to the axial direction of the dual ratchet sleeve; and (b) the first pawl is engaged in the tooth slots of the one-way forward ratchet ring gear, and the second pawl is disengaged from the tooth slots of the one-way reverse ratchet ring gear;

in the second position, the following conditions are occurred simultaneously:

(c) the longitudinal direction of the tool handle is parallel to the axial direction of the dual ratchet sleeve; and (d) the first pawl and the second pawl respectively disengage from the tooth slots corresponding to the one-way forward ratchet ring gear and the one-way reverse ratchet ring gear;

in the third position, the following conditions are occurred simultaneously:

(e) the longitudinal direction of the tool handle is perpendicular to the axial direction of the dual ratchet sleeve; and (f) the second pawl is engaged in the tooth slots of the one-way reverse ratchet ring gear, and the first pawl is disengaged from the tooth slots of the one-way forward ratchet ring gear.

2. The steering mechanism according to claim 1, wherein in the eccentric drive mechanism, the longitudinal direction of the pawl driving lever is defined to be parallel to the axis of the dual ratchet sleeve, and two side surfaces of the ratchet driving lever along the longitudinal direction is defined as a first side surface and a second side surface;

the pawl driving lever is set with a first pawl working section, a common working section and a second pawl working section in the longitudinal direction thereof;

the first pawl working section comprises on the first side surface a first inclined surface with an included angle with the longitudinal direction of the pawl driving lever;

the second pawl working section comprises a second inclined surface parallel to the first inclined surface on the second side surface, and the first inclined surface and the second inclined surface are oppositely arranged in the longitudinal direction of the pawl driving lever;

the common working section comprises a first parallel surface and a second parallel surface parallel to the longitudinal direction of the pawl driving lever on the first and second side surfaces, respectively, and the first parallel surface of the first side surface is adjacent to the first inclined surface to form a first a pawl drive surface, a second parallel surface of the second side is adjacent to the second inclined surface to form a second pawl drive surface;

the first pawl comprises a first guide portion that cooperates with the first pawl drive surface, and further comprises a first spring limit for position limitation, and a first return spring is disposed between the first spring limit and the pawl base;

the second pawl comprises a second guide portion that cooperates with the second pawl drive surface, and further comprises a second spring limit, a second return spring is disposed between the second spring limit and the pawl base.

3. The steering mechanism according to claim 2, wherein the first pawl is engaged in the tooth slots of the one-way forward ratchet ring gear through the elastic deformation force of the first return spring, the second pawl is engaged in the tooth slots of the one-way reverse ratchet ring gear through the elastic deformation force of the second return spring; both of the first pawl and the second pawl are disengaged from the one-way forward ratchet ring gear and the one-way reverse ratchet ring gear by the pawl driving lever.

4. The steering mechanism of claim 1, wherein while the one-way forward ratchet ring gear is engaged with the first pawl, and the one-way reverse ratchet ring gear is engaged with the second pawl, the movement direction of the first and second pawls is 0 to 5 degrees with respect to the working surface of the tooth slots of the one-way forward ratchet ring gear and one-way reverse ratchet ring gear, and the movement direction of the first and second pawls is 50 to 60 degrees with respect to the non-working surface of the tooth slots of the one-way forward ratchet ring gear and one-way reverse ratchet ring gear.

5. The steering mechanism according to claim 1, wherein the pawl base adopts a split type structure, and the upper portion of the pawl base comprises a fixed part base and a movable part, and the fixed part is integrated with the lower portion of the pawl base.

6. The steeling mechanism according to claim 5, wherein in the structure of the split-type pawl base, the working surfaces of the first pawl and the second pawl are located on the side of the movable part, and the non-working surfaces are located on the side of the fixed part.

7. The steering mechanism according to claim 1, wherein the axis of the driving lever guide hole is located at the center of the pawl base and coincides with the axis of the dual ratchet sleeve.

* * * * *